US005490533A

United States Patent [19]

Carter

[11] Patent Number: 5,490,533

[45] Date of Patent: Feb. 13, 1996

[54] COLLAPSIBLE SHELTER WITH ELEVATED CANOPY

[76] Inventor: Mark C. Carter, 10131 Kernwood Ct., Alta Loma, Calif. 91737

[21] Appl. No.: 42,996

[22] Filed: Apr. 5, 1993

[51] Int. Cl.[6] ..... E04H 15/50

[52] U.S. Cl. ..... 135/145; 135/151; 135/159

[58] Field of Search ..... 135/103, 109, 135/110, 114, 115, 107, 108, 106; 52/109

[56] References Cited

U.S. PATENT DOCUMENTS

| | | | |
|---|---|---|---|
| 1,712,836 | 5/1929 | Mills | 135/110 |
| 1,853,367 | 4/1932 | Mace | 135/110 |
| 3,199,518 | 8/1965 | Glidewell | 135/109 |
| 4,601,301 | 7/1986 | Hermanson | 135/110 X |
| 4,607,656 | 8/1986 | Carter . | |
| 4,641,676 | 2/1987 | Lynch | 135/110 X |
| 5,035,253 | 7/1991 | Bortles | 135/110 X |
| 5,244,001 | 9/1993 | Lynch | 135/109 X |
| 5,275,188 | 1/1994 | Tsai | 135/109 X |

*Primary Examiner*—Lanna Mai

*Attorney, Agent, or Firm*—Fulwider Patton Lee & Utecht

[57] ABSTRACT

The improved collapsible shelter includes a truss framework that provides an elevated, gabled canopy in a raised, extended configuration. The canopy is supported by at least three legs, and outer perimeter and central truss pairs of link members pivotally connected in scissors configurations. The link members of the perimeter truss pairs are pivotally connected together in a modified scissors configuration so as to be extendable from a first collapsed position extending horizontally between adjacent legs to a second extended position extending above the legs, to elevate the canopy in a gabled configuration. In a preferred embodiment, tensioning cables are also secured between the legs and a central support connected to the central truss pairs, to provide additional strength and stability to the framework of the shelter in a raised, extended configuration.

23 Claims, 5 Drawing Sheets

FIG. 3
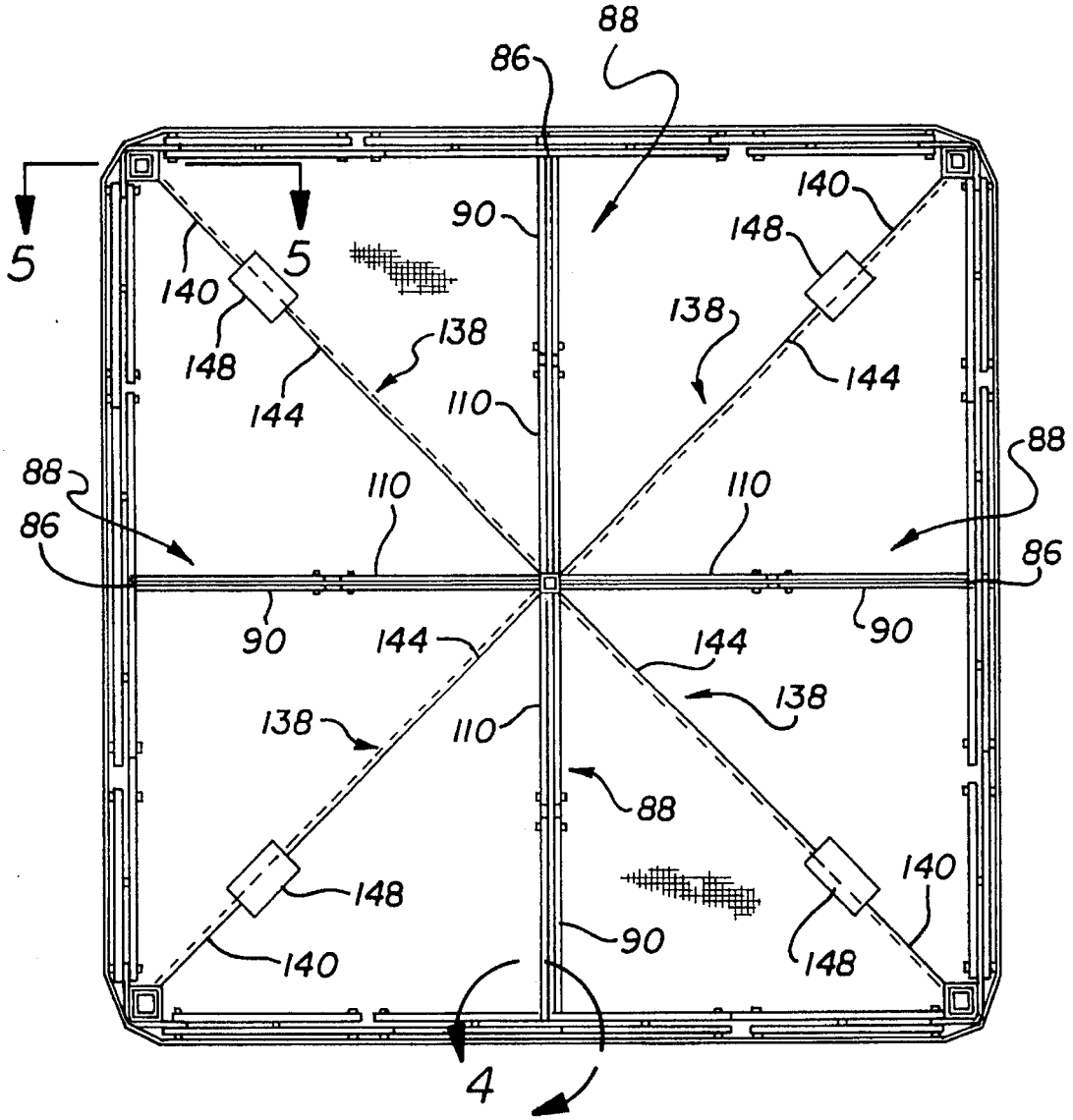
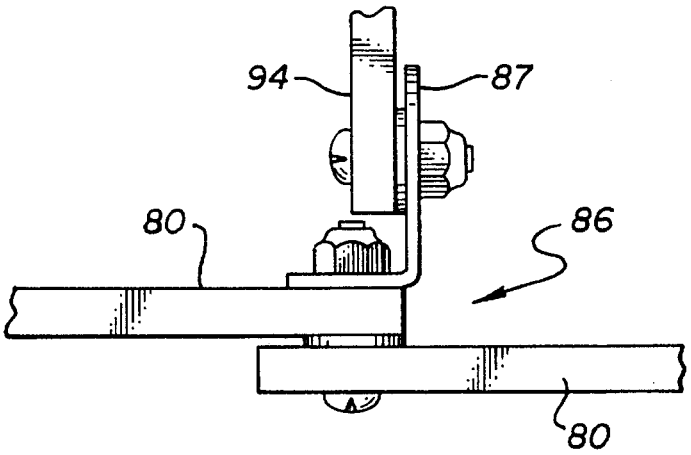
FIG. 4

COLLAPSIBLE SHELTER WITH ELEVATED CANOPY

BACKGROUND OF THE INVENTION

1. Field of the Invention

This invention relates generally to folding, collapsible structures, and more particularly relates to a collapsible, field shelter structure having an elevated canopy.

2. Description of Related Art

Temporary shelters that can be easily transported and rapidly set up at emergency sites can be particularly useful in providing temporary care and housing. Such shelters can also be useful for non-emergency outdoor gatherings, such as for temporary military posts, field trips, and the like. One such quickly erectable, collapsible shelter having a framework of X-shaped linkages, telescoping legs, and a canopy covering the framework is described in my U.S. Pat. No. 4,607,656. The legs of that shelter are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter. However, the height of the canopy is limited to the extended length of the legs, and the canopy is essentially flat, allowing for collection of precipitation and debris on top of the canopy, which can promote leaks and tears in the canopy. In addition, the size and stability of the shelter is generally limited by the strength of the framework.

It would be desirable to provide an improved collapsible shelter with a support framework for the canopy that rises above the supporting legs, to provide for more headroom within the structure, and to allow for a reduction in the size and weight of the legs and framework required to achieve an adequate height of the canopy. It would also be desirable to provide a canopy structure that is gabled to shed precipitation and debris from the top of the shelter. It would be further desirable to provide a shelter framework that would provide greater strength and stability, to allow support of larger, lighter collapsible shelter structures. The present invention fulfills these needs.

SUMMARY OF THE INVENTION

Briefly, and in general terms, the present invention provides for a collapsible shelter with an improved truss framework that raises a gabled shelter canopy to provide increased headroom, strength and stability.

The invention accordingly provides for a collapsible shelter having a canopy with at least three vertically disposed legs supporting the canopy. At least one perimeter truss means is connected to each of the legs. Each of the perimeter truss means preferably includes a pair of first and second link members, with the first link member having an outer end connected to the upper end of one leg, and the second link member having an outer end slidably connected to the leg. The first and second link members are pivotally connected together in a scissors configuration so as to be extendable from a first collapsed position extending horizontally between two legs to a second extended position extending above the legs. In a preferred embodiment, the perimiter truss means includes a second perimeter truss pair of link members connected to each of the first perimeter truss pairs, with the first link of the second perimeter truss pairs being pivotally connected to the second link of a corresponding first perimeter truss pair, and the second link of the second perimeter truss pair being pivotally connected to the first link of the corresponding first perimeter truss pair. The first and second link members of the second perimeter truss pairs are also preferably pivotally connected together in a modified scissors configuration so as to be extendable from a first collapsed position extending horizontally between legs to a second extended position extending above the first perimeter truss pair.

At least two central truss means are also provided, with each of the central truss means including a pair of first and second link members connected together in a scissors configuration. Each of the central truss pairs are connected to the inner ends of one perimeter truss means, and the first and second link members are pivotally connected together in a scissors configuration so as to be extendable from a first collapsed position to a second extended position. In a preferred embodiment, tensioning means are also secured between the leg slider member and the central support slider member, to provide additional strength and stability to the framework of the shelter in a raised, extended configuration.

In a preferred four-sided shelter embodiment, two first perimeter truss pairs of link members are connected to each of four legs. For each leg, the outer end of the first link of each truss pair connected to the leg is pivotally connected to the upper end of a leg, and the outer end of the second link is slidably connected to the leg, preferably being pivotally secured to a slider member on the leg. The first and second link members are pivotally connected together in a modified scissors configuration so as to be extendable from a first collapsed position extending horizontally between adjacent legs to a second extended position extending above the legs. Second perimeter truss pairs of link members are also preferably connected to each of the first perimeter truss pairs, with the first link of the second perimeter truss pairs being pivotally connected to the second link of a corresponding first perimeter truss pair, and the second link of the second perimeter truss pair being pivotally connected to the first link of the corresponding first perimeter truss pair. The first and second link members of the second perimeter truss pairs are also preferably pivotally connected together in a modified scissors configuration so as to be extendable from a first collapsed position extending horizontally between legs to a second extended position extending above the first perimeter truss pair. Each of the second perimeter truss pairs are preferably pivotally connected to another second perimeter truss pair.

At least two first central truss pairs of link members are also provided in the four-sided shelter embodiment, pivotally connected together in a scissors configuration are each connected to the inner ends of one of the perimeter truss pairs, and are preferably pivotally connected to a junction of the inner ends of second perimeter truss pairs. At least two second, inner central truss pairs of link members pivotally connected together in a scissors configuration are preferably each pivotally connected to the inner ends of one of the first, outer central truss pairs. The inner ends of the central truss pairs are preferably pivotally connected to the inner ends of at least one other of the inner central truss pairs, and are preferably pivotally connected to a vertically oriented central support member supporting the canopy and a central support slider member disposed to slidably engage the central support member. Tensioning means are also preferably provided between the leg slider member and the central support slider member.

These and other aspects and advantages of the invention will become apparent from the following detailed description, and the accompanying drawing, which illustrates by way of example the features of the invention.

BRIEF DESCRIPTION OF THE DRAWINGS

FIG. 3 is a top sectional view of the collapsible shelter of the invention;

FIG. 4 is an enlarged view of a portion of the linkage between the perimeter truss pairs and the central truss pairs;

DETAILED DESCRIPTION OF A PREFERRED EMBODIMENT

The size and available headroom of previous collapsible shelters have been generally limited by the extended length of the legs of the structure, and provided essentially flat roof structures, allowing for collection of precipitation in pockets or puddles on top of the shelter. The improved collapsible shelter of the invention provides for larger, lighter collapsible shelter structures, with a raised gabled roof structure which also improves the strength and stability of the shelter.

Figure 1:
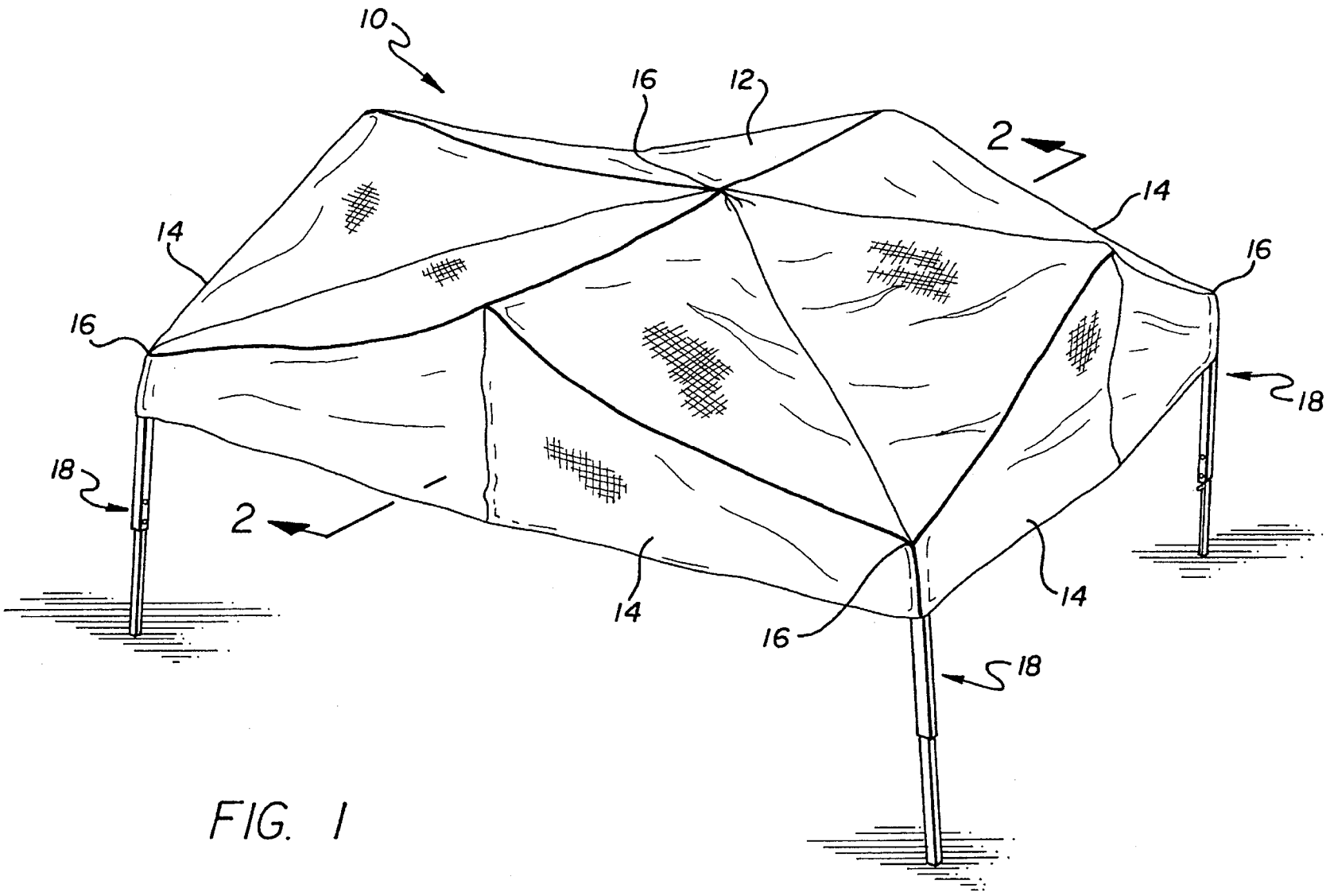
FIG. 1 is a perspective view of the improved collapsible shelter with an elevated canopy of the invention, showing the elevated gabled roof structure.
Figure 5:
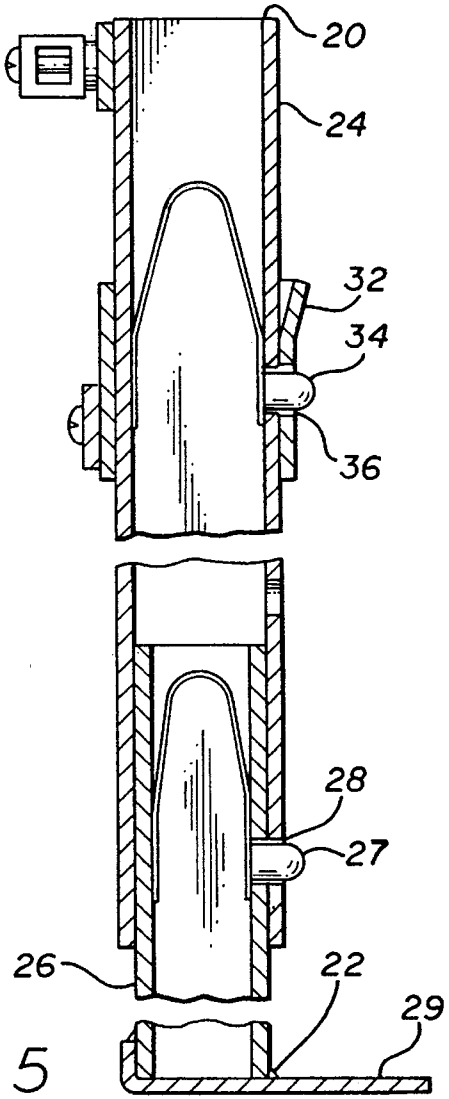
FIG. 5 is an enlarged sectional view of a leg of the collapsible shelter, taken along line 5—5 of FIG. 3.

As is illustrated in the drawings, and particularly referring to the four-sided preferred embodiment shown in FIG. 1, the invention is embodied in an improved collapsible shelter 10, having a canopy 12 with at least three sides 14, and preferably four sides, at least three corners 16, and preferably four corners. The canopy is preferably formed of nylon fabric, so as to be light and easily transportable, although the canopy could also be made of other suitable sheet materials, such as canvass, or other types of cloth fabric, or plastic. At least three, and preferably four, legs 18 supporting the canopy, with a leg disposed under each corner of the canopy. Particularly referring to FIGS. 2 and 5, each of the legs has an upper end 20 and a lower end 22, and preferably each leg includes telescoping upper and lower sections 24 and 26, respectively, with the telescoping lower section including a spring loaded detent pin 27 for indexing in apertures 28 provided in the upper section for adjusting the leg height as desired. The extendable lower section also preferably includes a foot portion 29 for engagement with the ground or other floor surface.

Figure 2:
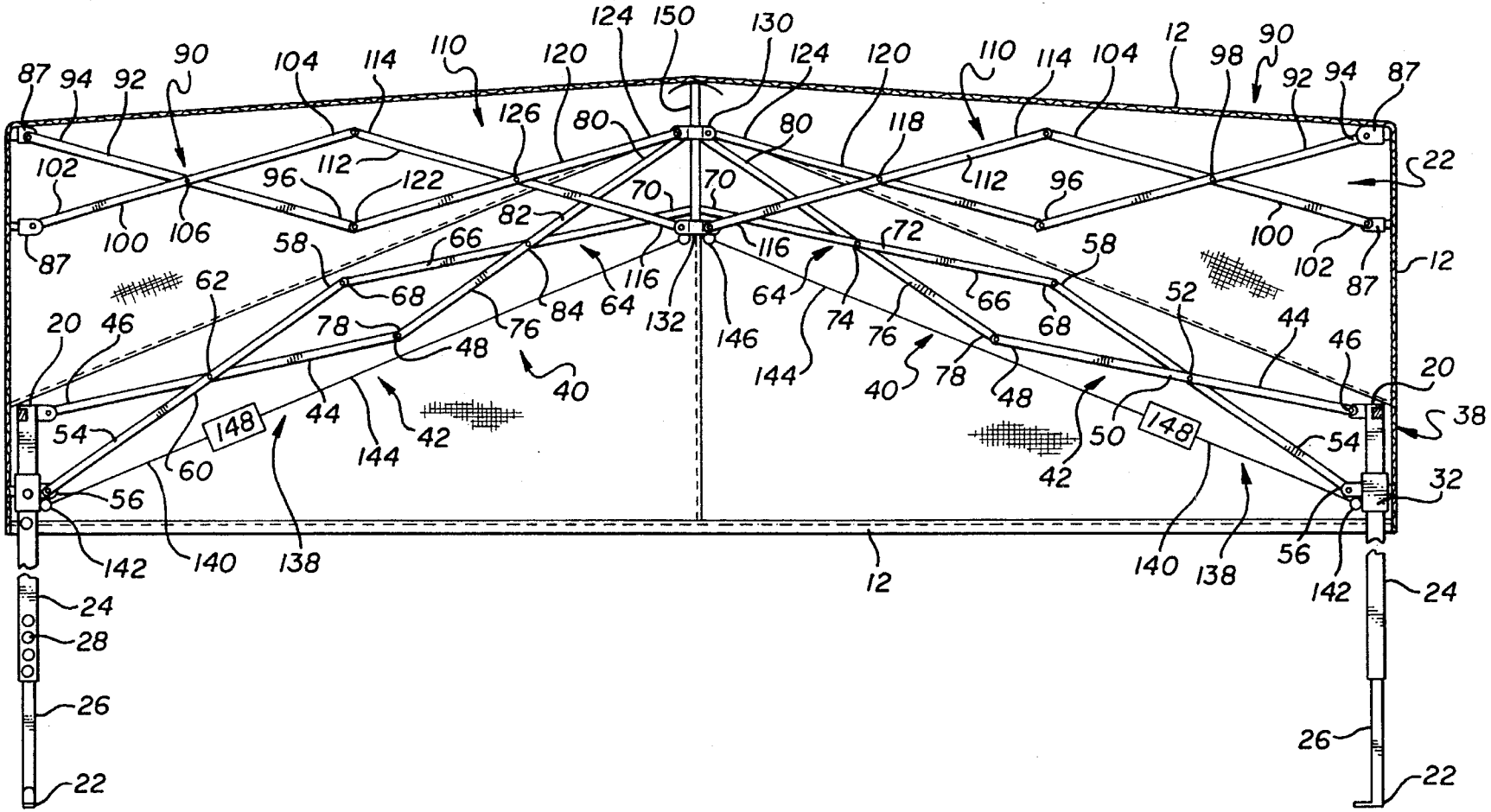
FIG. 2 is a cross-sectional elevational view of the collapsible shelter of the invention, taken along line 2—2 of FIG. 1, showing the perimeter and central truss pairs of the shelter in an extended, raised configuration.

As is best seen in FIG. 2, a leg slider member 32 is also slidably mounted on the upper section of each of the legs. A spring loaded detent pin 34 is also provided in the upper leg section for indexing with an aperture 36 in the leg slider member, as will be further explained below.

Figure 6:
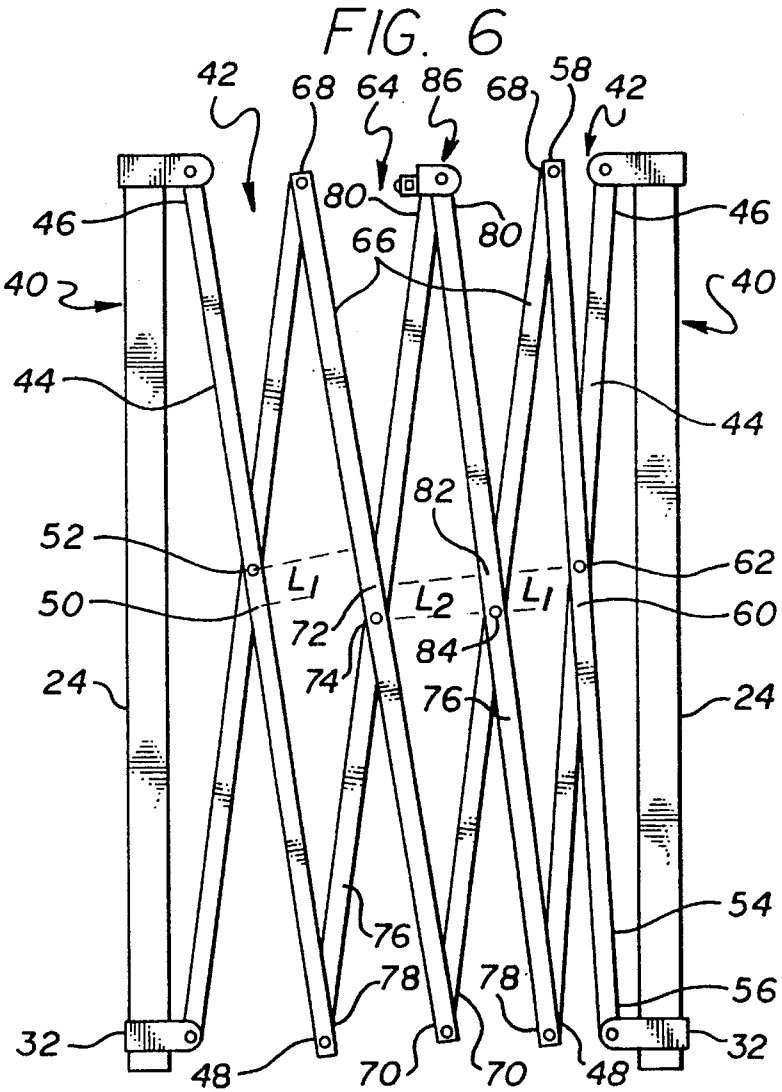
FIG. 6 is a side elevational view of the framework of the collapsible shelter, showing the perimeter truss pairs in a substantially collapsed configuration.

Referring to FIGS. 2 and 6, in the preferred four sided embodiment, the perimeter framework 38 includes perimeter truss means 40 including two first perimeter truss pairs 42 of link members connected to each of the legs at right angles, with each of the first perimeter truss pairs including a first link member 44 having an outer end 46 connected to the upper end of a leg, an inner end 48, a longitudinal center 50, and a pivot point 52 spaced apart from the longitudinal center toward the outer end by a predetermined distance $L_1$. Each of the first perimeter truss pairs further includes a second link 54 having an outer end 56 pivotally connected to the leg slider member, thus slidably connecting the second link to the upper section of the leg. The second link of the first perimeter truss pairs includes an inner end 58, a longitudinal center 60, and a pivot point 62 spaced apart from the longitudinal center toward the inner end by the same predetermined distance $L_1$. The pivot points of the first and second links in each of the first perimeter truss pairs are pivotally connected in a modified scissors configuration, so that although the first and second link members extend a short distance generally horizontally toward another leg in a first collapsed position of the shelter, as shown in FIG. 6, the first and second link members extend to a second extended position with the inner ends of the link members extending above the upper end of the leg, as shown in FIG. 2.

In a preferred embodiment, the perimeter truss means also includes a second perimeter truss pair 64 of link members, which is pivotally connected to each of the first perimeter truss pairs, to extend the framework further above the legs of the shelter. Each of the second perimeter truss pairs preferably includes a first link 66 having an outer end 68 pivotally connected to the inner end of the second link of the associated first perimeter truss pair, an inner end 70, a longitudinal center point 72, and a pivot point 74 spaced apart from the longitudinal center point toward the inner end a predetermined distance $L_2$. Each of the second perimeter truss pairs also preferably includes a second link 76 having an outer end 78 pivotally connected to the inner end of the first link of the associated first perimeter truss pair, an inner end 80, a longitudinal center point 82, and a pivot point 84 spaced apart from the longitudinal center point toward the outer end the predetermined distance $L_2$. The pivot points of the first and second links in each of the second perimeter truss pairs are preferably pivotally connected together, resulting in a modified scissors configuration so that the second truss pairs are also extendable from a first collapsed position extending generally horizontally between legs, to a second extended position extending above the first perimeter truss pair. The inner ends 70 and 80 of each second perimeter truss pair are further preferably pivotally connected to the inner ends 70 and 80 of another second perimeter truss pair at a junction 86 centered between two legs of one side of the shelter framework.

As is best seen in FIGS. 2, 3 and 4, a plurality of central truss means 88 are also provided, including at least two outer central truss pairs 90 of link members, with each of the outer central truss pairs being pivotally connected to the inner ends of at least one of the second perimeter truss pairs at the junction 86, such as by right angle bracket members 87, to which the inner ends of the second perimeter truss pairs and the outer central truss pairs are pivotally connected. In a preferred embodiment, the framework of the shelter has a square configuration, and four outer central truss pairs are provided, connected to the four side junctions of the shelter framework. Where the shelter framework has three sides, three outer central truss pairs may be provided. Each of the outer central truss pairs preferably includes a first link 92 having an outer end 94 connected to the inner end of the second link of the second perimeter truss pair, an inner end 96, and a pivot point 98 located at the longitudinal center point of the outer central truss pair first link. Each of the outer central truss pairs also preferably includes a second link 100 having an outer end 102 connected to the inner end of the first link of the second perimeter truss pair, an inner end 104, and a pivot point 106 located at the longitudinal center point of the outer central truss pair second link. Each of the pivot points of the first and second links of the outer central truss pairs are pivotally connected together to extend horizontally between the sides of the shelter framework.

In a preferred embodiment, the central truss means also includes at least two inner central truss pairs 110 of link members, with each of the inner central truss pairs being pivotally connected to the inner ends of an associated outer center truss pair. Each of the inner central truss pairs preferably includes a first link 112 having an outer end 114 connected to the inner end of the second link of the outer central truss pair, an inner end 116, and a pivot point 118 located at the longitudinal center point of the inner central truss pair first link. Each of the inner central truss pairs also preferably includes a second link 120 having an outer end 122 connected to the inner end of the first link of the outer central truss pair, an inner end 124, and a pivot point 126 located at the longitudinal center point of the inner central truss pair second link. Each of the pivot points of the first and second links of the inner central truss pairs are pivotally connected together to extend horizontally between the sides of the shelter framework. The inner ends of each of the first and second links of the inner central truss pairs are preferably pivotally connected to the inner ends of the first and second links of at least one other of the inner central truss pairs. The inner ends of the inner central truss pairs are preferably connected to at least one vertically oriented central support member 130 provided to support the canopy when the shelter framework is in an extended configuration. In a preferred embodiment, a central slider member 132 is pivotally connected to an inner end of the inner central truss pair, and is disposed to slidably engage the central support member when the shelter framework is in an extended configuration. The inner ends of each of the first links of the inner central truss pairs are preferably pivotally connected to one of the central support member and the central slider member, and the inner ends of each of the second links of the inner central truss pairs are preferably pivotally connected to the other of the central support member and the central slider member.

In the preferred four-sided shelter embodiment illustrated in FIGS. 2 and 3, a tensioning means 138 is preferably connected between the leg slider member and the central support slider member for adding strength and stability to the extended configuration of the shelter framework. The tensioning means preferably includes a first cable 140 secured to each leg by a bracket 142 on the leg slider, a second cable 144 secured to a bracket 146 on the center slider, and a cable lock 148, such as an over center type of cable lock, for example, securing the first and second cables together. The central support member may also include a peak pole member 150, for further extending the top center of the canopy above the shelter framework, to draw the canopy tight.

Figure 7:
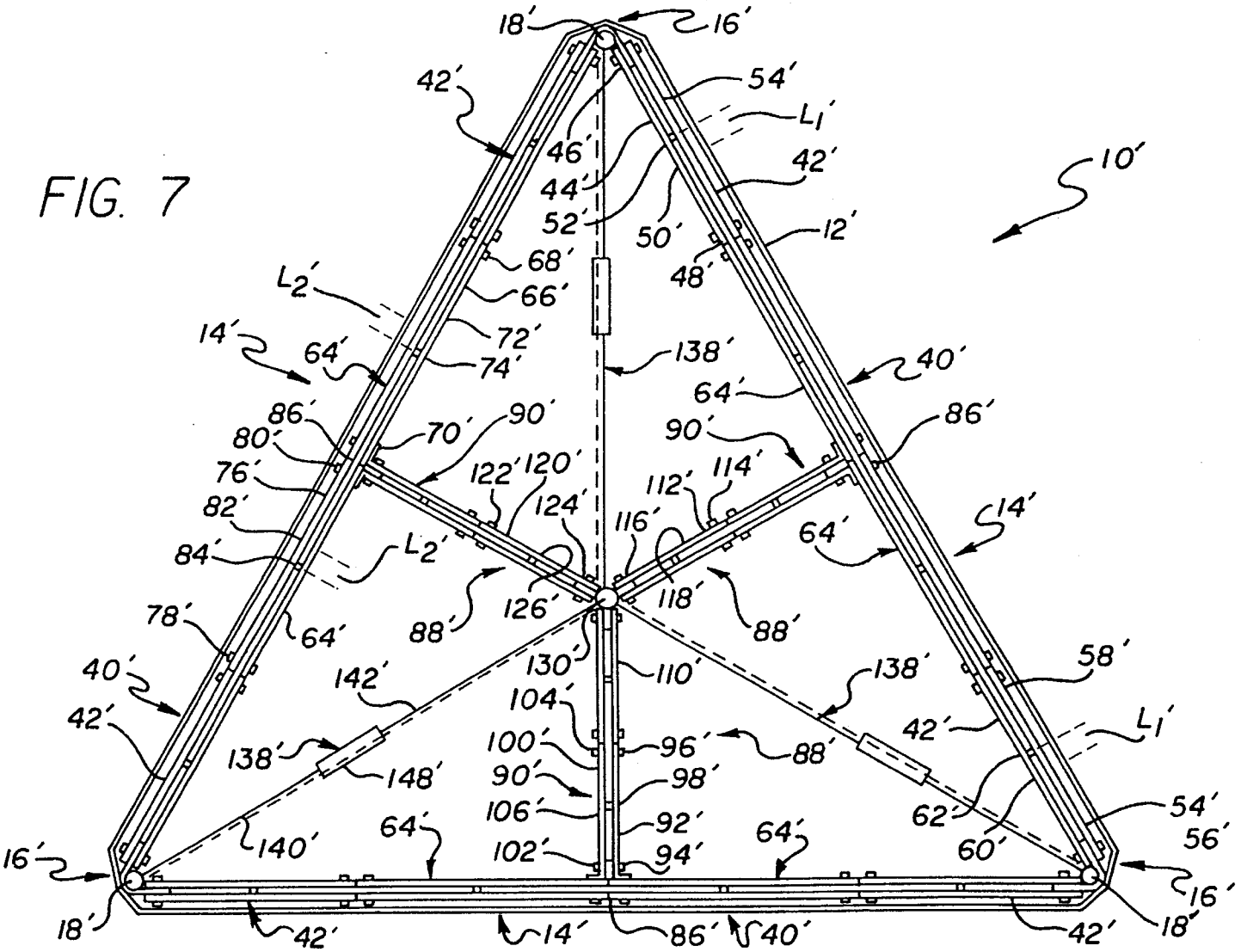
FIG. 7 is a top sectional view of a three-sided embodiment of the collapsible shelter of the invention, similar to that shown in FIG. 3.

A preferred three-sided embodiment of the collapsible shelter 10' of the invention is illustrated in FIG. 7, in which like reference numerals refer to like elements from the previous figures. The three-sided collapsible shelter is substantially similar to the four-sided embodiment illustrated in the previous figures, described above. The three-sided shelter includes a canopy 12' with three sides 14', and three corners 16'. Each leg 18' also preferably includes telescoping upper and lower sections for adjusting the leg height as desired, as described previously. A leg slider member is also slidably mounted on the upper section of each of the legs, as described above.

Referring to FIG. 7, the perimeter framework 38' includes perimeter truss means 40' including two first perimeter truss pairs 42' of link members connected to each of the legs at approximately 60 degree angles, with each of the first perimeter truss pairs including a first link member 44' having an outer end 46' connected to the upper end of a leg, an inner end 48', a longitudinal center 50', and a pivot point 52' spaced apart from the longitudinal center toward the outer end by a predetermined distance $L_1'$. Each of the first perimeter truss pairs further includes a second link 54' having an outer end 56' pivotally connected to the leg slider member, thus slidably connecting the second link to the upper section of the leg. The second link of the first perimeter truss pairs includes an inner end 58', a longitudinal center 60', and a pivot point 62' spaced apart from the longitudinal center toward the inner end by the same predetermined distance $L_1'$. The pivot points of the first and second links in each of the first perimeter truss pairs are pivotally connected in a modified scissors configuration, so that although the first and second link members extend a short distance generally horizontally toward another leg in a first collapsed position of the shelter, as previously shown in FIG. 6, the first and second link members extend to a second extended position with the inner ends of the link members extending above the upper end of the leg, as was previously shown in FIG. 2.

In the three-sided collapsible shelter embodiment, the perimeter truss means also includes a second perimeter truss pair 64' of link members, which is pivotally connected to each of the first perimeter truss pairs, to extend the framework further above the legs of the shelter. Each of the second perimeter truss pairs preferably includes a first link 66' having an outer end 68' pivotally connected to the inner end of the second link of the associated first perimeter truss pair, an inner end 70', a longitudinal center point 72', and a pivot point 74' spaced apart from the longitudinal center point toward the inner end a predetermined distance $L_2'$. Each of the second perimeter truss pairs also preferably includes a second link 76' having an outer end 78' pivotally connected to the inner end of the first link of the associated first perimeter truss pair, an inner end 80', a longitudinal center point 82', and a pivot point 84' spaced apart from the longitudinal center point toward the outer end the predetermined distance $L_2'$. The pivot points of the first and second links in each of the second perimeter truss pairs are preferably pivotally connected together, resulting in a modified scissors configuration so that the second truss pairs are also extendable from a first collapsed position extending generally horizontally between legs, to a second extended position extending above the first perimeter truss pair. The inner ends of each second perimeter truss pair are further preferably pivotally connected to the inner ends of another second perimeter truss pair at a junction 86' centered between two legs of one side of the shelter framework.

With further reference to FIG. 7, three central truss means 88' are also provided, including at least two outer central truss pairs 90' of link members, with each of the outer central truss pairs being pivotally connected to the inner ends of at least one of the second perimeter truss pairs at the junction 86', such as by right angle bracket members 87', to which the inner ends of the second perimeter truss pairs and the outer central truss pairs are pivotally connected. Each of the outer central truss pairs preferably includes a first link 92' having an outer end 94' connected to the inner end of the second link of the second perimeter truss pair, an inner end 96', and a pivot point 98' located at the longitudinal center point of the outer central truss pair first link. Each of the outer central truss pairs also preferably includes a second link 100' having an outer end 102' connected to the inner end of the first link of the second perimeter truss pair, an inner end 104', and a pivot point 106' located at the longitudinal center point of the outer central truss pair second link. Each of the pivot points of the first and second links of the outer central truss pairs are pivotally connected together to extend horizontally between the sides of the shelter framework.

In the three-sided collapsible shelter embodiment, each central truss means also includes an inner central truss pair 110' of link members, with each of the inner central truss pairs being pivotally connected to the inner ends of an associated outer center truss pair. Each of the inner central truss pairs preferably includes a first link 112' having an outer end 114' connected to the inner end of the second link of the outer central truss pair, an inner end 116', and a pivot point 118' located at the longitudinal center point of the inner central truss pair first link. Each of the inner central truss pairs also preferably includes a second link 120' having an outer end 122' connected to the inner end of the first link of the outer central truss pair, an inner end 124', and a pivot point 126' located at the longitudinal center point of the inner central truss pair second link. Each of the pivot points of the first and second links of the inner central truss pairs are pivotally connected together to extend horizontally between the sides of the shelter framework. The inner ends of each of the first and second links of the inner central truss pairs are preferably pivotally connected to the inner ends of the first and second links of at least one other of the inner central truss pairs. The inner ends of the inner central truss pairs are preferably connected to at least one vertically oriented central support member 130' provided to support the canopy when the shelter framework is in an extended configuration. As described above, a central slider member is also preferably pivotally connected to an inner end of the inner central truss pair, and is disposed to slidably engage the central support member when the shelter framework is in an extended configuration. The inner ends of each of the first links of the inner central truss pairs are preferably pivotally connected to one of the central support member and the central slider member, and the inner ends of each of the second links of the inner central truss pairs are preferably pivotally connected to the other of the central support member and the central slider member.

A tensioning means 138' is also preferably connected between the leg slider member and the central support slider member in the three-sided collapsible shelter embodiment. The tensioning means preferably includes a first cable 140' secured to each leg, a second cable 144' secured to the center slider, and a cable lock 148', such as an over center type of cable lock, for example, securing the first and second cables together. The central support member may also include a peak pole member (not shown) for further extending the top center of the canopy above the shelter framework, to draw the canopy tight.

In light of the above description, it will be apparent that the invention provides for a quickly erectable, collapsible shelter having an elevated roof, that is gabled to provide more headroom, and to provide greater strength and stability of the shelter when the framework is in an extended configuration.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A collapsible shelter, comprising:

a canopy having at least three sides and at least three corners;

at least three vertically disposed legs supporting said canopy, with one of said legs disposed under each of said canopy corners, each of said legs having an upper end and a lower end;

at least one perimeter truss means connected to each of said legs, each of said perimeter truss means including first and second link members, said first link member having an outer end connected to the upper end of one said leg, and said second link member having an outer end slidably connected to said leg, and said first and second link members being pivotally connected together in a scissors configuration, said first link member having a longitudinal center and a pivot point connected to said second link member, said pivot point of said first link member being spaced apart from said longitudinal center toward said outer end a predetermined distance, and said second link member having a longitudinal center and a pivot point connected to said first link member, said pivot point of said second link member being spaced apart from said second link member longitudinal center away from said outer end said predetermined distance, so that said perimeter truss means is extendable from a first collapsed position to a second extended position extending above said leg; and at least two central truss means, each said central truss means including a pair of first and second link members connected together in a scissors configuration, each of said central truss pairs being connected to the inner ends of one said perimeter truss means, said first and second link members being pivotally connected together in a scissors configuration so as to be extendable from a first collapsed position to a second extended position.

2. The collapsible shelter of claim 1, wherein said perimeter truss means comprises:

two first perimeter truss pairs of link members connected to each of said legs, each of said first perimeter truss pairs including a first link and a second link, said first link having an outer end connected to the upper end of one said leg, each second link having an outer end slidably connected to said leg, and said first and second link members being pivotally connected together in a scissors configuration so as to be extendable from a first collapsed position to a second extended position extending above said leg; and a second perimeter truss pair of link members connected to each of said first perimeter truss pairs, each of said second perimeter truss pairs including a first link and a second link, said first link being pivotally connected to said second link of a corresponding one of said first perimeter truss pairs, said second link being pivotally connected to said first link of said corresponding one of said first perimeter truss pairs, and said first and second link members being pivotally connected together in a scissors configuration so as to be extendable from a first collapsed position to a second extended position extending above said first perimeter truss pair.

3. The collapsible shelter of claim 2, wherein each of said second perimeter truss pairs is pivotally connected to one other second perimeter truss pair.

4. The collapsible shelter of claim 2, wherein each said central truss means comprises:

an outer central truss pair of link members, each of said outer central truss pairs being connected to the inner ends of one of said perimeter truss pairs, each said outer central truss pair including a first link and a second link, said first link having an outer end connected to the inner end of said second link of said second perimeter truss pair, and said second link having an outer end connected to the inner end of said first link of said second perimeter truss pair, said first and second links of said central truss pairs being pivotally connected together in a scissors configuration so as to be extendable from a first collapsed position to a second extended position; and an inner central truss pair of link members, each said inner central truss pair being pivotally connected to the inner ends of one of said outer central truss pairs, each of said inner central truss pairs including a first link and a second link, said first link having an outer end connected to the inner end of said second link of said central truss pair, and said second link having an outer end connected to the inner end of said first link of said central truss pair, said first and second links of said inner central truss pairs being pivotally connected together in a scissors configuration so as to be extendable from a first collapsed position to a second extended position.

5. The collapsible shelter of claim 4, wherein the inner ends of each of said first and second links of said inner central truss pairs are pivotally connected to the inner ends of the first and second links of at least one other of said inner central truss pairs.

6. The collapsible shelter of claim 4, further including a vertically oriented central support member for supporting said canopy, and a central support slider member disposed to slidably engage said central support member, the inner ends of each of said first links of said inner central truss pairs being pivotally connected to one of said central support member and said central support slider member, and the inner ends of each of said second links of said inner central truss pairs being pivotally connected to the other of said central support member and said central support slider member.

7. The collapsible shelter of claim 6, further including a leg slider member slidably mounted to each of said legs, each of said second link members being pivotally connected to one said leg slider member, and further including tensioning means connected between said leg slider member and said central support slider member.

8. The collapsible shelter of claim 7, wherein said tensioning means comprises a plurality of first cables, each said first cable being secured to one said leg slider, a plurality of second cables, each said second cable being secured to said central support slider member, and a cable locking means securing each of said first and said first cables to a corresponding second cable.

9. The collapsible shelter of claim 1, further including a leg slider member slidably mounted to each of said legs, and wherein each of said second link members is pivotally connected to one said leg slider member.

10. A collapsible shelter, comprising:

a canopy having at least four sides and at least four corners;

at least four legs supporting said canopy, with one of said legs disposed under each of said canopy corners, each of said legs having an upper and a lower portion;

two first perimeter truss pairs of link members connected to each of said legs, each of said first perimeter truss pairs including a first link and a second link, said first link having an outer end connected to the upper end of one said leg, an inner end, a center, and a center pivot point spaced apart from said center toward said outer end a predetermined distance, said second link having an outer end slidably connected to said leg, an inner end, a center, and a center pivot point spaced apart from said center toward said inner end said predetermined distance, said first and second links in each of said first perimeter truss pairs being pivotally connected together at said center pivot points in a scissors configuration so as to be extendable from a first collapsed position to a second extended position extending above said leg;

a second perimeter truss pair of link members connected to each of said first perimeter truss pairs, each of said second perimeter truss pairs including a first link and a second link, said first link having an outer end pivotally connected to said inner end of said second link of a corresponding one of said first perimeter truss pairs, an inner end, a center, and a center pivot point spaced apart from said center toward said inner end said predetermined distance, said second link having an outer end pivotally connected to said inner end of said first link of said corresponding one of said first perimeter truss pairs, an inner end, a center, and a center pivot point spaced apart from said center toward said outer end said predetermined distance, said center pivot points of said first and second links in each of said second perimeter truss pairs being pivotally connected together in a scissors configuration so as to be extendable from a first collapsed position to a second extended position extending above said first perimeter truss pair, and each of said inner ends of said second perimeter truss pairs being connected to the inner ends of one other second perimeter truss pair;

at least four outer central truss pairs of link members, each of said outer central truss pairs being connected to the inner ends of one of said second perimeter truss pairs, each of said outer central truss pairs including a first link and a second link, said first link having an outer end connected to the inner end of said second link of said second perimeter truss pair, an inner end, a center, and a center pivot point located at said center, and said second link having an outer end connected to the inner end of said first link of said second perimeter truss pair, an inner end, a center, and a center pivot point located at said center, each of said center pivot points of said first and second links of said outer central truss pairs being pivotally connected; and at least four inner central truss pair of link members, each of said inner central truss pairs being connected to the inner ends of one of said outer center truss pairs, each of said inner central truss pairs including a first link and a second link, said first link having an outer end connected to the inner end of said second link of said outer central truss pair, an inner end, a center, and a center pivot point located at said center, said second link having an outer end connected to the inner end of said first link of said outer central truss pair, an inner end, a center, and a center pivot point located at said center, each of said center pivot points of said first and second links of said inner central truss pairs being pivotally connected together, and the inner ends of each of said first and second links of said inner central truss pairs being pivotally connected to the inner ends of the first and second links of at least one other of said inner central truss pairs.

11. The collapsible shelter of claim 10, further including at least one vertically oriented central support member for supporting said canopy, and a central slider member disposed to slidably engage said central support member, the inner ends of each of said first links of said inner central truss pairs being pivotally connected to one of said central support member and said central slider member, and the inner ends of each of said second links of said inner central truss pairs being pivotally connected to the other of said central support member and said central slider member.

12. The collapsible shelter of claim 11, wherein each of said legs comprises a leg slider member, each of said leg slider members being slidably mounted to one of said legs, and each of said second link members of said first perimeter truss pairs of link members being pivotally connected to one of said leg slider members.

13. The collapsible shelter of claim 12, further including tensioning means connected between said plurality of leg slider members and said central slider member.

14. The collapsible shelter of claim 13, wherein said tensioning means comprises a plurality of first cables, and a plurality of second cables, each said first cables being secured to one said leg slider, each said second cables being secured to said central support slider member, and cable locking means securing each of said first cables to a corresponding second cable.

15. The collapsible shelter of claim 10, wherein each of said legs includes a telescoping top leg portion and an extendable bottom leg portion slidably mounted to said top section.

16. A collapsible shelter, comprising:

a canopy having at least three sides and at least three corners;

at least three vertically disposed legs supporting said canopy, with one of said legs disposed under each of said canopy corners, each of said legs having an upper end and a lower end;

at least one perimeter truss means connected to each of said legs, each of said perimeter truss means including first and second link members, said first link member having an outer end connected to the upper end of one said leg, and said second link member having an outer end slidably connected to said leg, and said first and second link members being pivotally connected together in a scissors configuration, said first link member having a longitudinal center and a pivot point connected to said second link member, said pivot point of said first link member being spaced apart from said longitudinal center toward said outer end a predetermined distance, and said second link member having a longitudinal center and a pivot point connected to said first link member, said pivot point of said second link member being spaced apart from said second link member longitudinal center away from said outer end said predetermined distance, so that said perimeter truss means is extendable from a first collapsed position to a second extended position extending above said leg;

at least two central truss means, each said central truss means including a pair of first and second link members connected together in a scissors configuration, each of said central truss pairs being connected to the inner ends of one said perimeter truss means, said first and second link members being pivotally connected together in a scissors configuration so as to be extendable from a first collapsed position to a second extended position, said central truss means comprising an outer central truss pair of link members, each of said outer central truss pairs being connected to the inner ends of one of said perimeter truss pairs, each said outer central truss pair including a first link and a second link, said first link having an outer end connected to the inner end of said second link of said second perimeter truss pair, and said second link having an outer end connected to the inner end of said first link of said second perimeter truss pair, said first and second links of said central truss pairs being pivotally connected together in a scissors configuration so as to be extendable from a first collapsed position to a second extended position;

an inner central truss pair of link members, each said inner central truss pair being pivotally connected to the inner ends of one of said outer central truss pairs, each of said inner central truss pairs including a first link and a second link, said first link having an outer end connected to the inner end of said second link of said central truss pair, and said second link having an outer end connected to the inner end of said first link of said central truss pair, said first and second links of said inner central truss pairs being pivotally connected together in a scissors configuration so as to be extendable from a first collapsed position to a second extended position;

a vertically oriented central support member for supporting said canopy, and a central support slider member disposed to slidably engage said central support member, the inner ends of each of said first links of said inner central truss pairs being pivotally connected to one of said central support member and said central support slider member, and the inner ends of each of said second links of said inner central truss pairs being pivotally connected to the other of said central support member and said central support slider member; and a leg slider member slidably mounted to each of said legs, each of said second link members being pivotally connected to one said leg slider member, and further including tensioning means connected between said leg slider member and said central support slider member.

17. The collapsible shelter of claim 16, wherein said tensioning means comprises a plurality of first cables, each said first cable being secured to one said leg slider, a plurality of second cables, each said second cable being secured to said central support slider member, and a cable locking means securing each of said first and said first cables to a corresponding second cable.

18. A collapsible shelter, comprising:

a canopy having at least three sides and at least three corners;

at least three vertically disposed legs supporting said canopy, with one of said legs disposed under each of said canopy corners, each of said legs having an upper and a lower end;

two first perimeter truss pairs of link members connected to each of said legs, each of said first perimeter truss pairs including a first link and a second link, said first link having an outer end connected to the upper end of one said leg, each said link having an outer end slidably connected to said leg, and said first and second link members being pivotally connected together and a scissors configuration so as to be extendable from a first collapsed position to a second extended position extending above said leg;

a second perimeter truss pair of link members connected to each of said first perimeter truss pairs, each of said second perimeter truss pairs including a first link and a second link, said first link being pivotally connected to said second link of a corresponding one of said first perimeter truss pairs, said second link being pivotally connected to said first link of said corresponding one of said first perimeter truss pairs, and said first and second link members being pivotally connected together in a scissors configuration so as to be extendable from a first collapsed position to a second extended position extending above said first perimeter truss pair, each of said second perimeter truss pairs being pivotally connected to one other second perimeter truss pair;

a plurality of outer central truss pairs of link members, each of said outer central truss pairs being connected to the inner ends of one of said perimeter truss pairs, each of said outer central truss pairs including a first link and a second link, said first link having an outer end connected to the inner end of said second link of said second perimeter truss pair, and said second link having an outer end connected to the inner end of said first link of said second perimeter truss pair, said first and second links of said outer central truss pairs being pivotally connected together in a scissors configuration so as to be extendable from a first collapsed position to a second extended position;

a plurality of inner central truss pairs of link members, each of said inner central truss pairs being connected to the inner ends of one of said outer central truss pairs, each of said inner central truss pairs including a first link and a second link, said first link having an outer end connected to the inner end of said second link of said central truss pair, and said second link having an outer end connected to the inner end of said first link of said central truss pair, said first and second links of said inner central truss pairs being pivotally connected together in a scissors configuration so as to be extendable from a first collapsed position to a second extended position, the inner ends of each of said first and second links of said inner central truss pairs being pivotally connected to the inner ends of the first and second links of at least one other of said inner central truss pairs;

a vertically oriented central support member for supporting said copy, and central support slider member disposed to slidably engage said central support member, the inner ends of each of said first links of said inner central truss pairs being pivotally connected to one of said central support member and said slider member, and the inner ends of each of said second links of said inner central truss pairs being pivotally connected to the other of said central support member and said slider member;

a plurality of leg slider members, each of said leg slider members being slidably mounted to one of said legs, and each of said second link members of said first perimeter truss pairs of link members being pivotally connected to one of said leg slider members; and tensioning means connected between said plurality of leg slider members and said central support slider member.

19. The collapsible shelter of claim 18, wherein said tensioning means comprises a plurality of first cables, each said first cable being secured to one said leg slider, a plurality of second cables, each said second cable being secured to said central support slider member, and a cable locking means securing each of said first and said first cables to a corresponding second cable.

20. A collapsible shelter, comprising:

a canopy having at least four sides and at least four corners;

at least four legs supporting said canopy, with one of said legs disposed under each of said canopy corners, each of said legs having an upper and a lower portion;

two first perimeter truss pairs of link members connected to each of said legs, each of said first perimeter truss pairs including a first link and a second link, said first link having an outer end connected to the upper end of one said leg, an inner end, a center, and a center pivot point spaced apart from said center toward said outer end a predetermined distance, said second link having an outer end slidably connected to said leg, an inner end, a center, and a center pivot point spaced apart from said center toward said inner end said predetermined distance, said first and second links in each of said first perimeter truss pairs being pivotally connected together at said center pivot points in a scissors configuration so as to be extendable from a first collapsed position to a second extended position extending above said leg;

a second perimeter truss pair of link members connected to each of said first perimeter truss pairs, each of said second perimeter truss pairs including a first link and a second link, said first link having an outer end pivotally connected to said inner end of said second link of a corresponding one of said first perimeter truss pairs, an inner end, a center, and a center pivot point spaced apart from said center toward said inner end said predetermined distance, said second link having an outer end pivotally connected to said inner end of said first link of said corresponding one of said first perimeter truss pairs, an inner end, a center, and a center pivot point spaced apart from said center toward said outer end said predetermined distance, said center pivot points of said first and second links in each of said second perimeter truss pairs being pivotally connected together in a scissors configuration so as to be extendable from a first collapsed position to a second extended position extending above said first perimeter truss pair, and each of said inner ends of said second perimeter truss pairs being connected to the inner ends of one other second perimeter truss pair;

at least four outer central truss pairs of link members, each of said outer central truss pairs being connected to the inner ends of one of said second perimeter truss pairs, each of said outer central truss pairs including a first link and a second link, said first link having an outer end connected to the inner end of said second link of said second perimeter truss pair, an inner end, a center, and a center pivot point located at said center, and said second link having an outer end connected to the inner end of said first link of said second perimeter truss pair, an inner end, a center, and a center pivot point located at said center, each of said center pivot points of said first and second links of said outer central truss pairs being pivotally connected;

at least four inner central truss pairs of link members, each of said inner central truss pairs being connected to the inner ends of one of said outer center truss pairs, each of said inner central truss pairs including a first link and a second link, said first link having an outer end connected to the inner end of said second link of said outer central truss pair, an inner, a center and center pivot point located at said center, said second link having an outer end connected to the inner end of said first link of said outer central truss pair, an inner end, a center and center pivot point located at said center, each of said center pivot points of said first and second links of said inner central truss pairs being pivotally connected together, and the inner ends of each of said first and second links of said inner central truss pairs being pivotally connected to the inner ends of the first and second links of at least one other of said inner central truss pairs;

at least one vertically oriented central support member for supporting said canopy, and a central slider member disposed to slidably engage said central support member, the inner ends of each of said first links of said inner central truss pairs being pivotally connected to one of said central support member and said central slider member, and the inner ends of each of said second links of said inner central truss pairs being pivotally connected to the other of said central support member and said central slider member;

each of said legs including a leg slider member, each of said leg slider members being slidably mounted to one of said legs, and each of said second link members of said first perimeter truss pairs of link members being pivotally connected to one of said leg slider members; and tensioning means connected between said plurality of leg slider members and said central slider member.

21. The collapsible shelter of claim 20, wherein said tensioning means comprises a plurality of first cables, each said first cable being secured to one said leg slider, a plurality of second cables, each said second cable being secured to said central support slider member, and a cable locking means securing each of said first and said first cables to a corresponding second cable.

22. A collapsible shelter, comprising:

a canopy having at least three sides and at least three corners;

at least three vertically disposed legs supporting said canopy, with one of said legs disposed under each of said canopy corners, each of said legs having an upper end and a lower end;

at least one perimeter truss means connected to each of said legs, each of said perimeter truss means including first and second link members, said first link member having an outer end connected to the upper end of one said leg, and said second link member having an outer end slidably connected to said leg, and said first and second link members being pivotally connected together in a scissors configuration so as to be extendable from a first collapsed position to a second extended position extending above said leg;

at least two central truss means, each said central truss means including a pair of first and second link members connected together in a scissors configuration, each of said central truss pairs being connected to the inner ends of one said perimeter truss means, said first and second link members being pivotally connected together in a scissors configuration so as to be extendable from a first collapsed position to a second extended position, said central truss means comprising an outer central truss pair of link members, each of said outer central truss pairs being connected to the inner ends of one of said perimeter truss pairs, each said outer central truss pair including a first link and a second link, said first link having an outer end connected to the inner end of said second link of said second perimeter truss pair, and said second link having an outer end connected to the inner end of said first link of said second perimeter truss pair, said first and second links of said central truss pairs being pivotally connected together in a scissors configuration so as to be extendable from a first collapsed position to a second extended position;

an inner central truss pair of link members, each said inner central truss pair being pivotally connected to the inner ends of one of said outer central truss pairs, each of said inner central truss pairs including a first link and a second link, said first link having an outer end connected to the inner end of said second link of said central truss pair, and said second link having an outer end connected to the inner end of said first link of said central truss pair, said first and second links of said inner central truss pairs being pivotally connected together in a scissors configuration so as to be extendable from a first collapsed position to a second extended position;

a vertically oriented central support member for supporting said canopy, and a central support slider member disposed to slidably engage said central support member, the inner ends of each of said first links of said inner central truss pairs being pivotally connected to one of said central support member and said central support slider member, and the inner ends of each of said second links of said inner central truss pairs being pivotally connected to the other of said central support member and said central support slider member; and a leg slider member slidably mounted to each of said legs, each of said second link members being pivotally connected to one said leg slider member, and further including tensioning means connected between said leg slider member and said central support slider member.

23. The collapsible shelter of claim 22, wherein said tensioning means comprises a plurality of first cables, each said first cable being secured to one said leg slider, a plurality of second cables, each said second cable being secured to said central support slider member, and a cable locking means securing each of said first and said first cables to a corresponding second cable.

* * * * *